US011073776B2

(12) United States Patent
Shinohara et al.

(10) Patent No.: US 11,073,776 B2
(45) Date of Patent: Jul. 27, 2021

(54) IMAGE FORMING APPARATUS, IMAGE FORMING METHOD AND NON-TRANSITORY RECORDING MEDIUM

(71) Applicant: TOSHIBA TEC KABUSHIKI KAISHA, Tokyo (JP)

(72) Inventors: Eiji Shinohara, Mishima Shizuoka (JP); Kazuhiko Kikuchi, Yokohama Kanagawa (JP); Sasuke Endo, Chigasaki Kanagawa (JP); Masaya Tanaka, Sunto Shizuoka (JP); Ryota Saeki, Sunto Shizuoka (JP); Kousei Miyashita, Sunto Shizuoka (JP); Ryosuke Kojima, Sunto Shizuoka (JP); Yohei Doi, Mishima Shizuoka (JP); Yuki Kawashima, Tagata Shizuoka (JP); Kiyotaka Murakami, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 9 days.

(21) Appl. No.: 16/574,628

(22) Filed: Sep. 18, 2019

(65) Prior Publication Data

US 2021/0080880 A1 Mar. 18, 2021

(51) Int. Cl.
*G03G 15/20* (2006.01)
*G03G 15/00* (2006.01)

(52) U.S. Cl.
CPC ..... *G03G 15/2039* (2013.01); *G03G 15/2053* (2013.01); *G03G 15/2064* (2013.01); *G03G 15/5004* (2013.01); *G03G 15/5045* (2013.01); *G03G 2215/00772* (2013.01)

(58) Field of Classification Search
None
See application file for complete search history.

(56) References Cited

U.S. PATENT DOCUMENTS

| | | | | |
|---|---|---|---|---|
| 4,569,585 | A * | 2/1986 | Masuda | G03G 15/55 399/19 |
| 2015/0063845 | A1* | 3/2015 | Miyazaki | G03G 15/205 399/37 |
| 2017/0205740 | A1* | 7/2017 | Cao | G03G 15/2039 |
| 2019/0072887 | A1* | 3/2019 | Ishikawa | G03G 15/2039 |

FOREIGN PATENT DOCUMENTS

| | | | |
|---|---|---|---|
| JP | 2010020150 A | * | 1/2010 |
| JP | 2014-006375 A | | 1/2014 |

OTHER PUBLICATIONS

Machine translation of Fujimori (Year: 2010).*

* cited by examiner

*Primary Examiner* — Sevan A Aydin
(74) *Attorney, Agent, or Firm* — Foley & Lardner LLP

(57) ABSTRACT

An image forming apparatus includes a heater, a fixing device, and a controller. The heater includes a heat generator that generates heat when the heater is turned on. The fixing device may fix a developer image on a surface of an image forming medium using the heat from the heat generator. The controller detects a voltage of a power supply for supplying electric power to the heater, and determines an occurrence of an abnormality in the heater if a voltage drop amount at the time the heater is turned on as compared to a case in which the heater is turned off is smaller than a first threshold value.

17 Claims, 5 Drawing Sheets

IMAGE FORMING APPARATUS, IMAGE FORMING METHOD AND NON-TRANSITORY RECORDING MEDIUM

FIELD

Embodiments herein relate generally to an image forming apparatus, an image forming method, and a non-transitory recording medium.

BACKGROUND

An image forming apparatus, such as a printer, often includes a fixing device, which may include a heater.

In the image forming apparatus, damage to the heater of the fixing device may be detected. For example, if a temperature of the fixing device does not rise during operation, a method may be used to detect damage to the fixing device.

However, in the conventional image forming apparatus, it may be unclear whether the fixing device is damaged due to an abnormality in the heater.

DETAILED DESCRIPTION

Because a conventional image forming apparatus may not distinguish between a failure in the heater of the fixing device and a failure of the sensor monitoring the heater of the fixing device, the image forming apparatus cannot reliably or accurately determine an actual cause for a non-functioning fixing device.

In accordance with an embodiment, an image forming apparatus comprises a heater, a fixing device (fixer), and a control section (a controller). The heater is turned on or turned off, and a heat generation section (heat generator) generates heat when the heater is turned on. The fixing device fixes a developer image on a surface of an image forming medium with the heat from the heat generation section. The control section detects a voltage of a power supply for supplying electric power to the heater, and determines abnormality occurring in the heater if a voltage drop amount at the time the heater is turned on as compared to a case in which the heater is turned off is smaller than a first threshold value.

Hereinafter, an image forming apparatus, an image forming method and a non-transitory recording medium of an embodiment are described with reference to the accompanying drawings.

Figure 1:
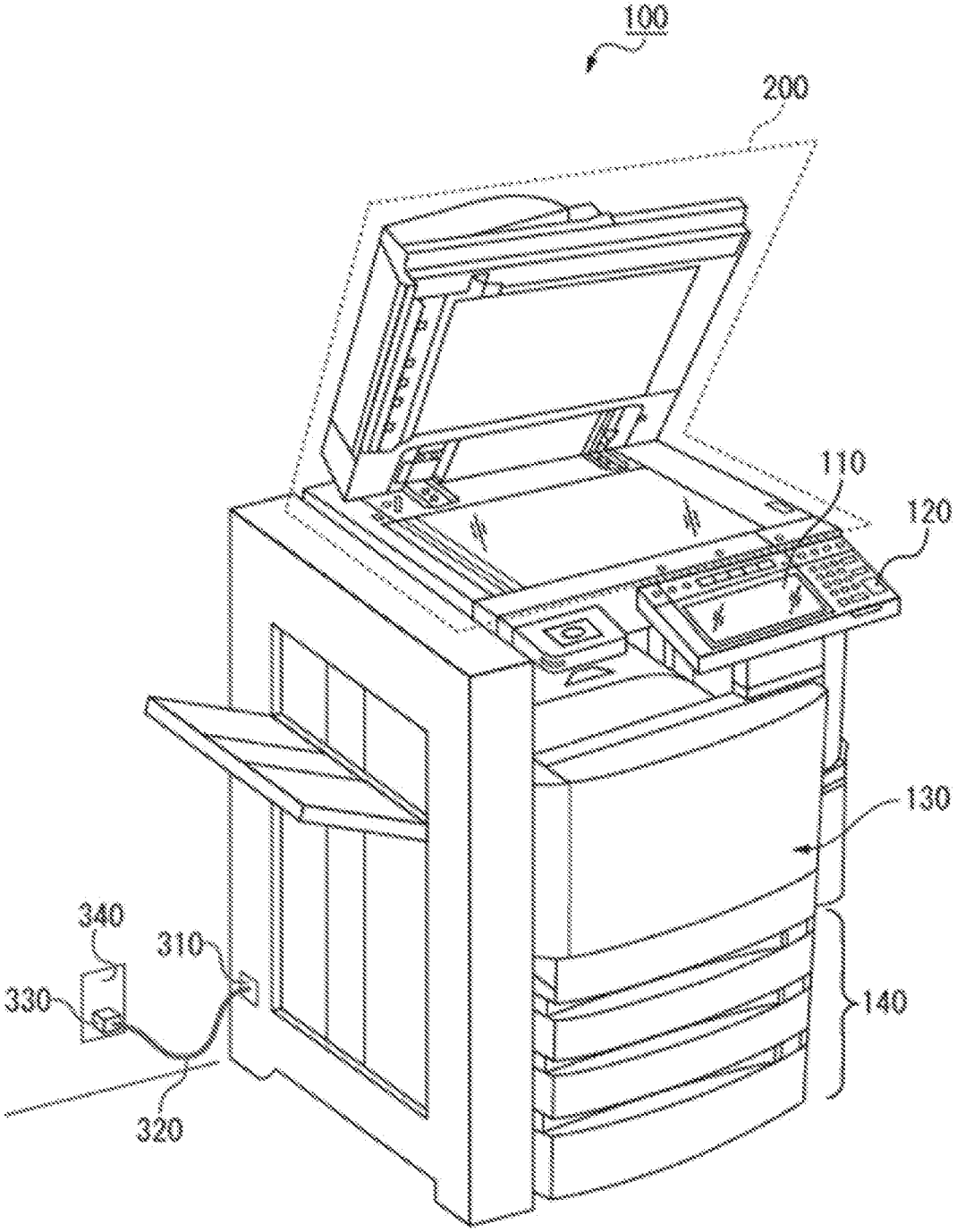
FIG. 1 is an external view illustrating an overall configuration of an image forming apparatus according to at least one embodiment.
Figure 2:
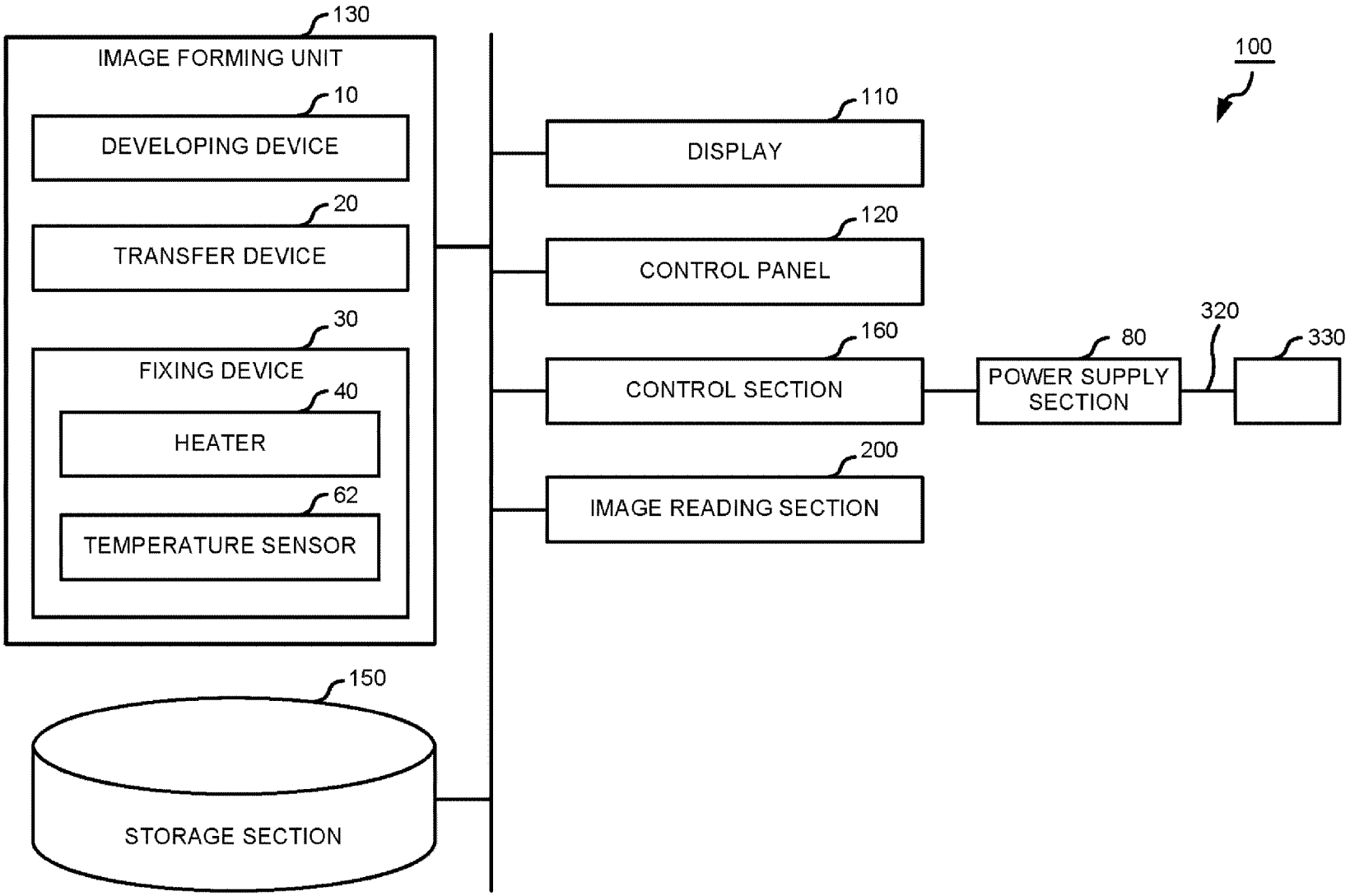
FIG. 2 is a hardware block diagram illustrating the image forming apparatus according to at least one embodiment.

FIG. 1 is an external view illustrating an overall configuration of an image forming apparatus 100 according to at least one embodiment. FIG. 2 is a hardware block diagram illustrating the image forming apparatus 100 according to at least one embodiment. The image forming apparatus 100 is, for example, a multi-function peripheral device. The image forming apparatus 100 includes a display 110, a control panel 120, an image forming unit 130 (e.g., a printer), a sheet housing section 140 (e.g., a cassette or tray), a storage section 150 (e.g., a memory), a control section (or a controller) 160, an image reading section 200 (e.g., a scanner), a power supply port 310, a power supply cord 320, an attachment plug 330 and a power supply section (power supply) 80.

In FIG. 1, a plug receptacle for commercial power supply 340 is shown together with the image forming apparatus 100. For example, the plug receptacle for commercial power supply 340 is provided on a wall of a building.

In the image forming apparatus 100, the power supply cord 320 extends from the power supply port 310 to the outside. The attachment plug 330 is provided at a tip of the power supply cord 320. The attachment plug 330 is inserted into the plug receptacle for commercial power supply 340. The electric power supplied from a commercial power supply is input to the power supply section 80 via the attachment plug 330 and the power supply cord 320.

The power supply section 80 distributes the electric power to each section including the image forming unit 130 in the image forming apparatus 100. The power supply section 80 applies the input voltage of the commercial power supply to the control section 160.

The power supply section 80 may include a converter for converting an input AC voltage of the commercial power supply to a DC voltage. In this case, the power supply section 80 may apply the DC voltage converted by the converter to the control section 160.

In the image forming apparatus 100, the use of current by a heater of the fixing device 30 causes the decrease in a voltage to be applied to the control section 160 from the power supply section 80.

The image forming apparatus 100 forms an image on a sheet using a developer such as a toner. The developer is fixed to the sheet when heated. The sheet is, for example, a paper or a label paper. Any type of sheet can be used as long as the image forming apparatus 100 can form an image on a surface thereof.

The display 110 is an image display device such as a liquid crystal display, an organic EL (Electro Luminescence) display and the like. The display 110 displays various kinds of information relating to the image forming apparatus 100.

The control panel 120 includes a plurality of buttons. The control panel 120 receives an operation from a user. The control panel 120 outputs a signal corresponding to the operation performed by the user to the control section 160. The display 110 and the control panel 120 may be integrated with each other to form a touch panel.

The image forming unit 130 forms an image on the sheet based on image information generated by the image reading section 200 or image information received through a communication line. The image forming unit 130 includes a developing device (developer) 10, a transfer device 20 and a fixing device 30. The fixing device 30 includes a heater 40 and a temperature sensor 62. The temperature sensor 62 detects a temperature of the heater 40. The temperature sensor 62 outputs a signal indicating the detected temperature to the control section 160.

The heater 40 may be called a heater unit or the like.

The image forming unit 130 forms an image through the following processing, for example. The developing device 10 of the image forming unit 130 forms an electrostatic latent image on a photoconductive drum based on the image information. The developing device 10 of the image forming unit 130 forms a visible image (developer image) by attaching the developer to the electrostatic latent image. For example, the developer is a toner. The toner may be a decolorable toner, a non-decolorable toner, a decorative toner, or the like. The non-decolorable toner is a normal toner.

The transfer device 20 of the image forming unit 130 transfers the visible image onto the sheet.

The fixing device 30 of the image forming unit 130 fixes the visible image to the sheet by heating and pressurizing the sheet. The sheet on which the image is formed may be a sheet accommodated in the sheet housing section 140, or a sheet that is manually fed.

The sheet housing section 140 accommodates a sheet to be used for image formation in the image forming unit 130.

The storage section 150 is a magnetic hard disk device, a semiconductor storage device or the like. The storage section 150 stores data required at the time the image forming apparatus 100 operates. The storage section 150 may temporarily store image data formed in the image forming apparatus 100.

The control section 160 is configured by a processor such as a CPU (Central Processing Unit) and a memory. The control section 160 reads out a program stored in the storage section 150 in advance to execute it. The control section 160 controls the operation of each device of the image forming apparatus 100.

The control section 160 controls the electric power to be supplied to the heater 40.

The control section 160 determines a power supply voltage applied by the power supply section 80, e.g., by detecting the voltage.

A signal output from the temperature sensor 62 is input to the control section 160. The control section 160 detects the temperature indicated by the signal input from the temperature sensor 62.

The image reading section 200 reads image information of a reading object as intensity of light. The image reading section 200 records the read image information. The recorded image information may be transmitted to another information processing apparatus via a network. The recorded image information may be used for forming an image on the sheet by the image forming unit 130. The image reading section 200 may include an ADF (Auto Document Feeder).

Figure 3:
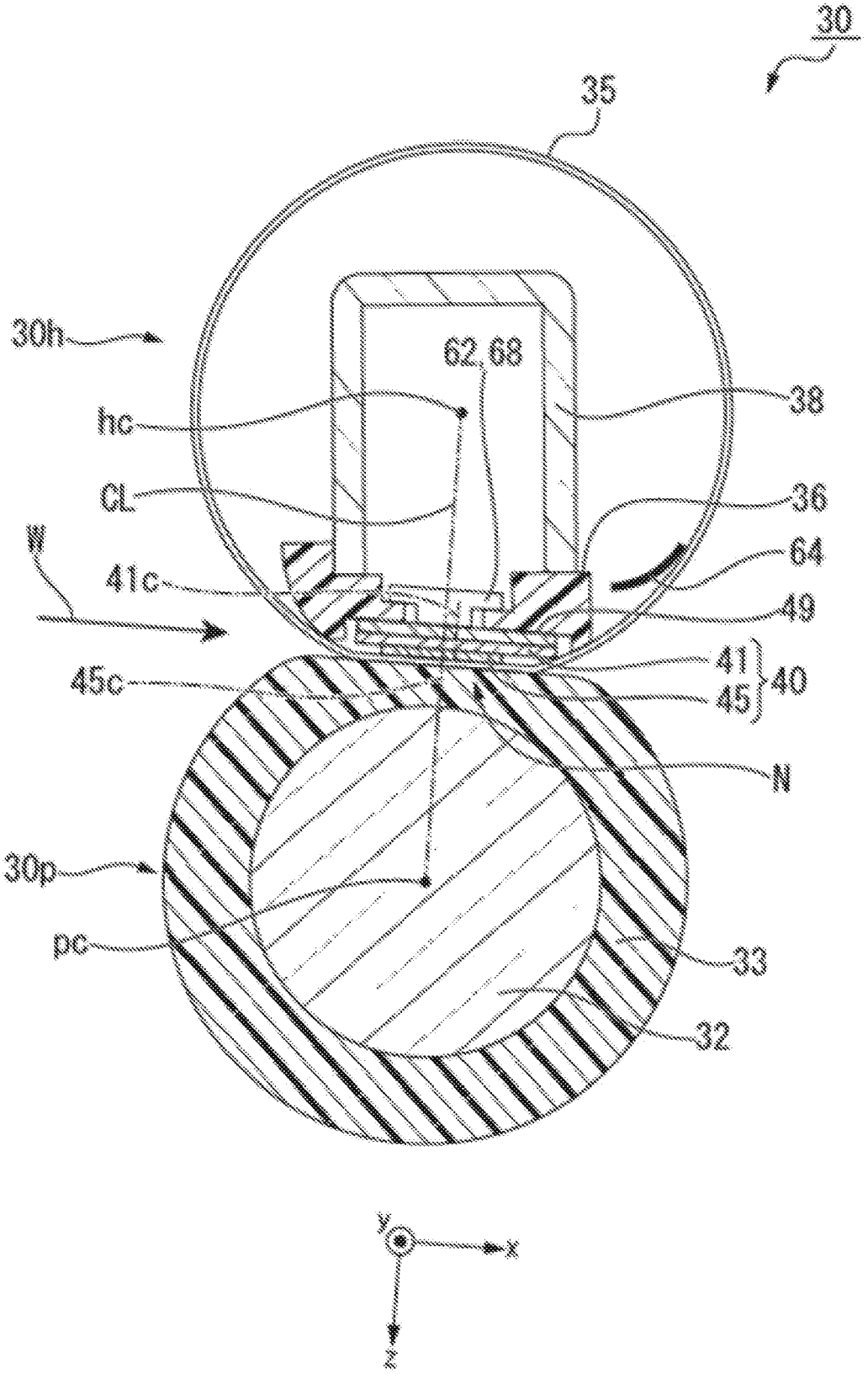
FIG. 3 is a front sectional view illustrating a fixing device according to at least one embodiment.

FIG. 3 is a front sectional view illustrating the fixing device 30 according to the embodiment. The fixing device 30 of the embodiment includes a pressure roller 30*p* and a film unit (film assembly) 30*h*.

An xyz orthogonal coordinate system is shown in FIG. 3 for convenience of description.

The pressure roller 30*p* can be rotatably driven, and the pressure roller 30*p* can be pressed against a surface of the film unit 30*h*. The pressure roller 30*p* forms a nip N between the pressure roller 30*p* and the film unit 30*h* if the pressure roller 30*p* is pressed against the surface of the film unit 30*h*. The pressure roller 30*p* pressurizes the visible image on the sheet entering the nip N. When the pressure roller 30*p* is rotatably driven, the pressure roller 30*p* rotates to convey the sheet. For example, the pressure roller 30*p* includes a core 32, an elastic layer 33 and a release layer (not shown).

The core 32 having a cylindrical shape is made of a metal material such as stainless steel. Both ends in an axial direction of the core 32 are rotatably supported. The core 32 is rotatably driven by a motor (not shown). The core 32 abuts on a cam member (not shown).

The elastic layer 33 is made of an elastic material such as silicone rubber or the like. The elastic layer 33 is formed on an outer circumferential surface of the core 32 at a constant thickness. The release layer (not shown) is formed on an outer circumferential surface of the elastic layer 33. The release layer is made of a resin material such as PFA (tetrafluoroethylene-perfluoroalkyl vinyl ether copolymer).

The pressure roller 30*p* is rotatably driven by a motor to rotate. If the pressure roller 30*p* rotates in a state in which the nip N is formed, a cylindrical film (thin film) 35 of the film unit 30*h* is driven to rotate. The pressure roller 30*p* rotates in a state in which the sheet is positioned at the nip N to convey the sheet in a conveyance direction W.

The film unit 30*h* heats the visible image on the sheet entering the nip N. The film unit 30*h* includes the cylindrical film (cylindrical body) 35, the heater 40, a heat transfer member 49, a support member 36, a stay (a support) 38, a temperature sensor 62, a thermostat 68 and a film thermometer 64. The thermostat 68 is configured to be controlled by the control section and to output temperature information to the control section.

The cylindrical film 35 has a cylindrical shape. The cylindrical film 35 includes a base layer, an elastic layer, and a release layer in order from an inner circumferential side thereof. The base layer having a cylindrical shape is made of a material such as nickel (Ni). The elastic layer is superimposed on an outer circumferential surface of the base layer. The elastic layer is made of an elastic material such as silicone rubber. The release layer is superimposed on an outer circumferential surface of the elastic layer. The release layer is made of a material such as PFA resin.

The heater 40 includes a base plate 41 and a heating element 45. The base plate 41 is a heating element base plate. The base plate 41 is made of a metal material such as stainless steel or nickel, or a ceramic material such as aluminum nitride. The base plate 41 has a long and thin rectangular plate shape. The base plate 41 is arranged on the inner side in a radial direction of the cylindrical film 35. The base plate 41 extends along the axial direction of the cylindrical film 35.

The heating element 45 is formed on the surface of the base plate 41. The heating element 45 may be a single heating element or may include a plurality of heating element portions. If the heating element 45 includes a plurality of heating element portions, the plurality of heating element portions is arranged side by side in a main scanning direction.

The heating element 45 is formed by a heating resistor such as a silver-palladium alloy. An energization amount for the heating element 45 is controlled by the control section 160.

As shown in FIG. 3, the heater 40 is arranged at the inner side of the cylindrical film 35. A lubricant (not shown) is applied to the inner circumferential surface of the cylindrical film 35. The heater 40 contacts the inner circumferential surface of the cylindrical film 35 via the lubricant. If the heater 40 generates heat, viscosity of the lubricant decreases. In this way, the slidability between the heater 40 and the cylindrical film 35 is ensured. Thus, the cylindrical film 35 is a belt-like thin film sliding on the surface of the heater 40 with one surface thereof contacting the heater 40.

The support member 36 is made of a resin material such as a liquid crystal polymer. The support member 36 supports the heater 40. The support member 36 supports the inner circumferential surface of the cylindrical film 35 at both ends of the heater 40.

The stay 38 is made of a steel plate material or the like. For example, a cross section of the stay 38 may be U-shaped. The stay 38 is mounted in such a manner that a U-shaped opening is sealed by the support member 36. Both ends of the stay 38 are fixed to a housing of the image forming apparatus 100. In this way, the film unit 30*h* is supported in the image forming apparatus 100.

The temperature sensor 62 detects a temperature. The temperature sensor 62 is arranged in the vicinity of the heater 40. In this way, the temperature sensor 62 detects a temperature of the heater 40.

The thermostat 68 is arranged in the vicinity of the heater in the same manner as the temperature sensor 62. The thermostat 68 shuts off the energization to the heating element if the measured temperature of the heater 40 exceeds a predetermined temperature.

In FIG. 3, a center pc of the pressure roller 30*p*, a center hc of the film unit 30*h* and a straight line CL connecting the two centers are shown.

In FIG. 3, a center 45*c* in an x direction of the heating element 45 and a center 41*c* in the x direction of the base plate 41 are shown.

In the image forming apparatus 100 of at least one embodiment, an on-demand system is used as a fixing system. In the on-demand system, power consumption in the image forming apparatus 100 can be reduced. In such an on-demand system, a film is driven by a rotation member provided with the elastic layer 33. In the on-demand system, the conveyed sheet and the developer are heated by the heater 40 through the film.

Figure 4:
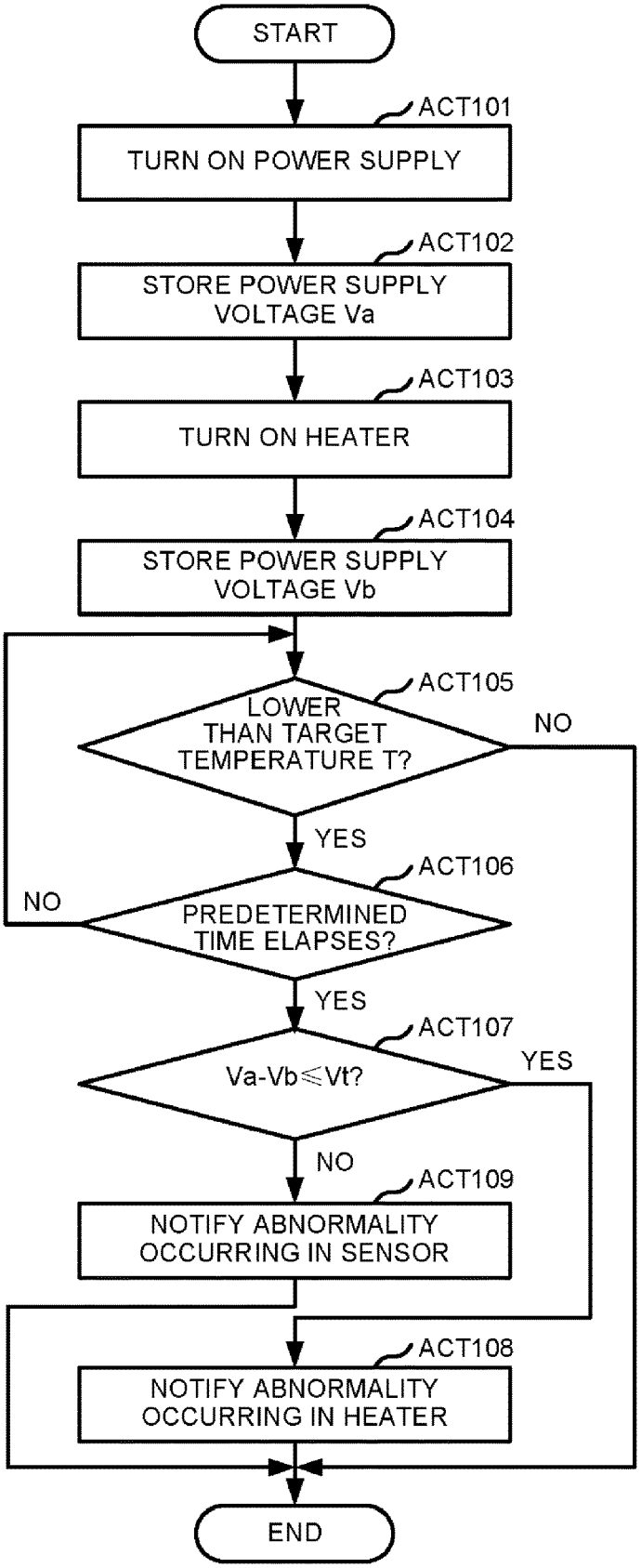
FIG. 4 is a diagram illustrating a first specific example of a flow of an operation performed by the image forming apparatus according to at least one embodiment.

FIG. 4 is a diagram illustrating a first specific example of a flow of an operation performed by the image forming apparatus 100 according to the embodiment.

The image forming apparatus 100 is started if a power supply thereof is turned on (Act 101). At this time, the heater 40 is turned off.

Thereafter, the control section 160 detects a voltage value Va of a power supply applied by the power supply section 80. Then, the control section 160 stores the detected voltage value Va in the storage section 150 (Act 102). For example, the control section 160 detects the voltage value Va immediately after the power supply is turned on.

Next, the control section 160 turns on the heater 40 (Act 103).

Thereafter, the control section 160 detects a voltage value Vb of a power supply applied by the power supply section 80 again. Then, the control section 160 stores the detected voltage value Vb in the storage section 150 (Act 104). For example, the control section 160 detects the voltage value Vb of the power supply when a predetermined time elapses since the heater 40 is turned on. The predetermined time may be set to any time. For example, the predetermined time is stored in advance in the storage section 150. The control section 160 reads out the predetermined time stored in the storage section 150 to use it.

Next, the control section 160 detects the temperature detected by the temperature sensor 62. Then, the control section 160 determines whether the detected temperature is lower than a target temperature T (Act 105). The target temperature T is stored in advance in the storage section 150. The control section 160 reads out the target temperature T stored in the storage section 150 to use it.

Instead of a processing for determining whether the detected temperature is lower than the target temperature T, a processing of determining whether the detected temperature is equal to or lower than the target temperature T may be performed.

If it is determined that the detected temperature is not lower than the target temperature T (No in Act 105), the control section 160 terminates the processing in this flow. That the detected temperature is not lower than the target temperature T means that the detected temperature reaches the target temperature T. In this case, in this example, it is considered that the heater 40 and the temperature sensor 62 are normal.

On the other hand, if it is determined that the detected temperature is lower than the target temperature T (Yes in Act 105), the control section 160 performs the processing in ACT 106. In Act 106, the control section 160 determines whether a predetermined time X elapses since the heater 40 is turned on (Act 106). The predetermined time X may be any time, and for example, may be several seconds. The predetermined time X is stored in advance in the storage section 150. The control section 160 reads out the predetermined time X stored in the storage section 150 to use it.

If it is determined that the predetermined time X does not elapse since the heater 40 is turned on (No in Act 106), the control section 160 returns to the processing in Act 105. Specifically, the control section 160 determines whether the detected temperature is lower than the target temperature T again (Act 105).

On the other hand, if it is determined that the predetermined time X elapses since the heater 40 is turned on (Yes in Act 106), the control section 160 performs the processing in Act 107. In Act 107, the control section 160 determines whether a value obtained by subtracting the detected voltage Vb from the detected voltage Va is equal to or smaller than a predetermined threshold value Vt (Act 107). For example, the threshold value Vt may be set to 5V.

Instead of the processing of determining whether the value obtained by subtracting the voltage Vb from the voltage Va is equal to or smaller than the predetermined threshold value Vt, a processing of determining whether the value obtained by subtracting the voltage Vb from the voltage Va is smaller than the predetermined threshold value Vt may be performed.

The value obtained by subtracting the voltage Vb from the voltage Va indicates a voltage drop amount of the power supply after the predetermined time elapses since the heater 40 is turned on. In at least one embodiment, if the voltage drop amount (Va-Vb) is equal to or smaller than a predetermined threshold value Vt, it is considered that the heater 40 is not operating normally and an abnormality (e.g., unusual or unexpected behavior or performance, such as caused by damage or failure of structure or components) occurs in the heater 40.

If it is determined that the value obtained by subtracting the voltage Vb from the voltage Va is equal to or smaller than a predetermined threshold value Vt (Yes in Act 107), the control section 160 notifies the abnormality occurring in the heater 40 (Act 108). Specifically, the control section 160 displays a message for notifying the abnormality occurring in the heater 40 on the display 110. For example, this message contains an error code. As another embodiment, the control section 160 may output a sound or the like for notifying the abnormality occurring in the heater 40. Then, the control section 160 terminates the processing in this flow.

On the other hand, if it is determined that the value obtained by subtracting the voltage Vb from the voltage Va is greater than the predetermined threshold value Vt (No in Act 107), the control section 160 notifies the abnormality occurring in the temperature sensor 62 (Act 109). Specifically, the control section 160 displays a message for notifying the abnormality occurring in the temperature sensor 62 on the display 110. For example, this message contains an error code. As yet another embodiment, the control section 160 may output a sound or the like for notifying the abnormality occurring in the temperature sensor 62. Then, the control section 160 terminates the processing in this flow.

Figure 5:
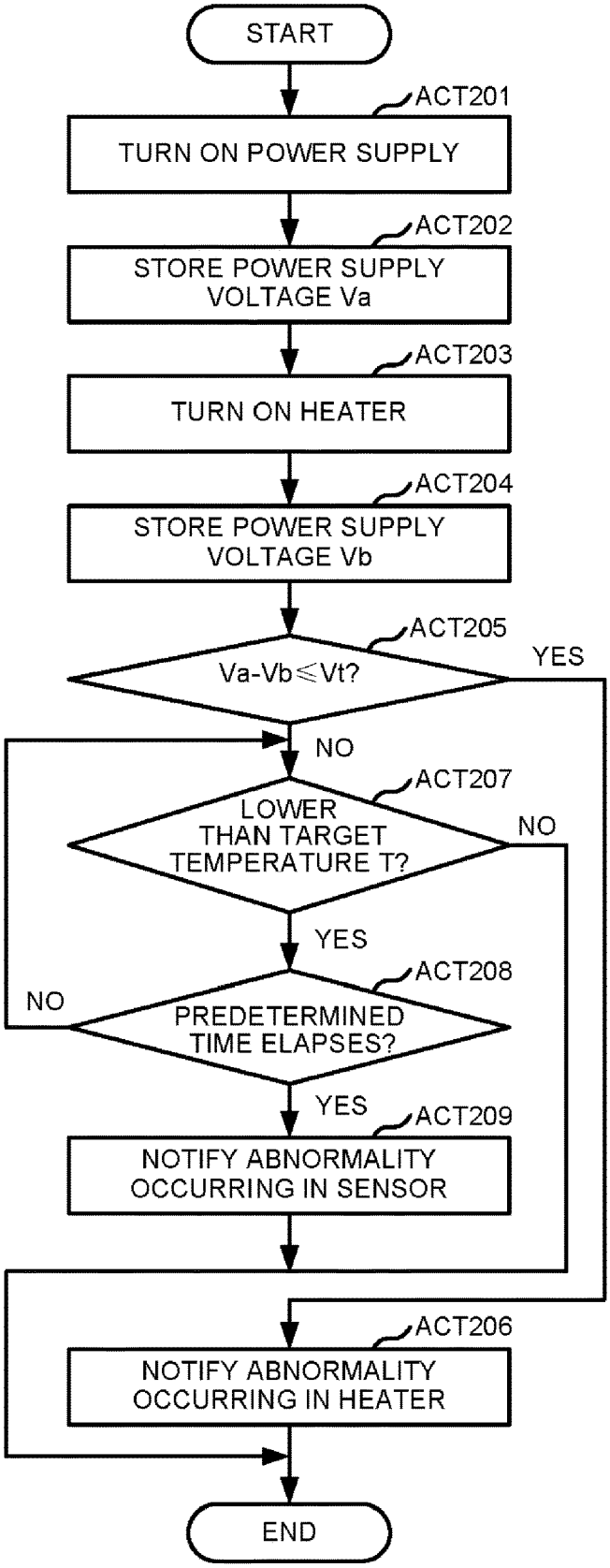
FIG. 5 is a diagram illustrating a second specific example of a flow of the operation performed by the image forming apparatus according to at least one embodiment.

FIG. 5 is a diagram illustrating a second specific example of the flow of the operation performed by the image forming apparatus according to at least one embodiment.

For convenience of description, in describing the process of FIG. 5, the description is simplified for portions that are the same as those of the process illustrated in FIG. 4.

From the start of this flow, the processing in Act 201, the processing in Act 202, the processing in Act 203 and the processing in Act 204 are the same as the processing in Act 101, the processing in Act 102, the processing in Act 103 and the processing in Act 104 from the start of the flow shown in FIG. 4, respectively.

The processing performed after the processing in Act 204 in this flow is described.

The control section 160 determines whether the value obtained by subtracting the detected voltage Vb from the detected voltage Va is equal to or smaller than the predetermined threshold value Vt (Act 205).

Instead of the processing of determining whether the value obtained by subtracting the voltage Vb from the voltage Va is equal to or smaller than the predetermined threshold value Vt, the processing of determining whether the value obtained by subtracting the voltage Vb from the voltage Va is smaller than the predetermined threshold value Vt may be performed.

If it is determined that the value obtained by subtracting the voltage Vb from the voltage Va is equal to or smaller than the predetermined threshold value Vt (Yes in Act 205), the control section 160 notifies the abnormality occurring in the heater 40 (Act 206). Then, the control section 160 terminates the processing in this flow.

On the other hand, if it is determined that the value obtained by subtracting the voltage Vb from the voltage Va is greater than the predetermined threshold value Vt (No in Act 205), the control section 160 performs the processing in Act 207. In Act 207, the control section 160 detects the temperature detected by the temperature sensor 62. Then, the control section 160 determines whether the detected temperature is lower than the target temperature T (Act 207).

Instead of the processing of determining whether the detected temperature is lower than the target temperature T, a processing of determining whether the detected temperature is equal to or lower than the target temperature T may be performed.

If it is determined that the detected temperature is not lower than the target temperature T (No in Act 207), the control section 160 terminates the processing in this flow.

On the other hand, if it is determined that the detected temperature is lower than the target temperature T (Yes in Act 207), the control section 160 performs the processing in Act 208. In Act 208, the control section 160 determines whether the predetermined time X elapses since the heater 40 is turned on (Act 208).

If it is determined that the predetermined time X does not elapse since the heater 40 is turned on (No in Act 208), the control section 160 returns to the processing in Act 207. Specifically, the control section 160 performs the processing of determining whether the detected temperature is lower than the target temperature T again (Act 207).

On the other hand, if it is determined that the predetermined time X elapses since the heater 40 is turned on (Yes in Act 208), the control section 160 notifies the abnormality occurring in the temperature sensor 62 (Act 209). Then, the control section 160 terminates the processing in this flow.

In the example in FIG. 5, the control section 160 performs the processing in Act 205 to compare the voltage drop amount (Va-Vb) with the threshold value Vt at the time the voltage value Vb is detected. For this reason, in the example in FIG. 5, if the abnormality occurs in the heater 40, the abnormality can be determined quickly. In this way, in the image forming apparatus 100, the time required to determine the abnormality occurring in the heater 40 can be shortened.

In the image forming apparatus 100, the control section 160 may continue the subsequent operations if it is determined that the abnormality occurs in the heater 40. In other words, in this case, the image forming apparatus 100 may be kept in a usable state.

Alternatively, in this case, in the image forming apparatus 100, the control section 160 may stop the operation of the image forming apparatus 100. At this time, the image forming apparatus 100 may be started to enter the usable state if the power supply thereof is turned on again after the power supply thereof is temporarily turned off.

On the other hand, in the image forming apparatus 100, the control section 160 at least stops the operation in which the fixing device 30 is used if it is determined that the abnormality occurs in the temperature sensor 62. In other words, in this case, the image forming apparatus 100 at least cannot perform the operation in which the fixing device 30 is used. For example, the operation in which the fixing device 30 is used includes printing.

As described above, in the image forming apparatus 100, if a component of the fixing device 30 is damaged, the abnormality occurring in the heater 40 can be determined based on the voltage drop amount of the power supply voltage. Furthermore, in the image forming apparatus 100, whether the abnormality occurs in the heater 40 or in the temperature sensor 62 can be determined based on the detected value of the temperature.

For example, in the image forming apparatus 100, the control section 160 detects the power supply voltage value at the time of controlling the heater 40. Then, the control section 160 determines that the abnormality occurs in the heater 40 if the power supply voltage does not drop or if the drop amount of the power supply voltage at the time the heater 40 is turned on as compared to the case in which the heater 40 is turned off is small.

In the image forming apparatus 100, despite the heater 40 being turned on, the abnormality occurring in the heater 40 is determined under a predetermined condition. The predetermined condition refers to a condition that the detected value of the temperature sensor 62 does not rise to the target temperature T, and the voltage drop amount (Va-Vb) when the heater 40 is turned on is equal to or smaller than the predetermined threshold value Vt.

In the image forming apparatus 100, despite that the heater 40 is turned on, the abnormality occurring in the temperature sensor 62 is determined under a predetermined condition. The predetermined condition refers to a condition that the detected value of the temperature sensor 62 does not rise to the target temperature T, and the voltage drop amount (Va-Vb) when the heater 40 is turned on exceeds the predetermined threshold value Vt.

In the image forming apparatus 100, it may be unclear whether the reason for the damage of the fixing device 30 is the abnormality of the heater 40 or the abnormality of the temperature sensor 62. Therefore, in the image forming apparatus 100, these can be determined.

In at least one embodiment, the fixing device 30 including the film unit 30*h* and the pressure roller 30*p* is used; however, it is not limited thereto. For example, a fixing device including a heating roller and a pressure roller may be used.

An example of the image forming apparatus 100, an image forming method and a non-transitory (non-temporary) recording medium of at least one embodiment are shown.

As one embodiment, the image forming apparatus 100 comprises the heater 40, the fixing device 30, and the control section 160.

The heater 40 is turned on or turned off, and the heating element 45 generates heat when the heater 40 is turned on.

The fixing device 30 uses the heat from the heating element 45 to fix the developer image on the surface of an image forming medium. In at least one embodiment, the image forming medium is a sheet, but is not limited thereto. The heater 40 is integrated with the fixing device 30 in at least one embodiment; however, the heater 40 and the fixing device 30 may be separate from each other.

The control section 160 detects a voltage of a power supply that supplies electric power to the heater 40. Then, the control section 160 determines the abnormality occurring in the heater 40 if the voltage drop amount (Va-Vb) at the time the heater 40 is turned on as compared to a case in which the heater 40 is turned off is smaller than a first threshold value. In at least one embodiment, the first threshold value is Vt.

Therefore, in the image forming apparatus 100, the abnormality occurring in the heater 40 can be determined.

As one embodiment, the image forming apparatus 100 further includes the temperature sensor 62 that detects the temperature of the fixing device 30. In at least one embodiment, the temperature sensor 62 is integrated with the fixing device 30; however, the temperature sensor 62 and the fixing device 30 may be separate from each other.

The control section 160 determines the abnormality occurring in the heater 40 based on the temperature detected by the temperature sensor 62 in a predetermined case. The predetermined case refers to a case in which the temperature is lower than a second threshold value and the voltage drop amount (Va-Vb) at the time the heater 40 is turned on as compared to a case in which the heater 40 is turned off is smaller than the first threshold value. In at least one embodiment, the second threshold value is the target temperature T.

Therefore, in the image forming apparatus 100, an abnormality occurring in the heater 40 can be determined between the heater 40 and the temperature sensor 62.

As one embodiment, in the image forming apparatus 100, the control section 160 determines whether the temperature is lower than the second threshold value based on the temperature at the time the predetermined time elapses since the heater 40 is turned on.

Therefore, in the image forming apparatus 100, the determination relating to the temperature can be performed based on the condition at the time the predetermined time elapses since the heater 40 is turned on. Thereby, in the image forming apparatus 100, the determination relating to the temperature can be accurately performed.

As one embodiment, in the image forming apparatus 100, the control section 160 determines the abnormality occurring in the temperature sensor 62 in a predetermined case. The predetermined case refers to a case in which the temperature detected by the temperature sensor 62 is lower than a third threshold value and the voltage drop amount (Va-Vb) at the time the heater 40 is turned on as compared to a case in which the heater 40 is turned off is greater than the first threshold value. In at least one embodiment, the third threshold value is the target temperature T.

Therefore, in the image forming apparatus 100, the abnormality occurring in the temperature sensor 62 can be determined between the heater 40 and the temperature sensor 62.

As an example, if the voltage drop amount (Va-Vb) is coincident with the first threshold value, the same processing as in the case in which the voltage drop amount (Va-Vb) is smaller than the first threshold value may be performed. As another example, if the voltage drop amount (Va-Vb) is coincident with the first threshold value, the same processing as in a case in which the voltage drop amount (Va-Vb) is greater than the first threshold value may be performed.

As one embodiment, in the image forming apparatus 100, the control section 160 determines whether the temperature is lower than the third threshold value based on a temperature at the time a predetermined time elapses since the heater 40 is turned on.

Therefore, in the image forming apparatus 100, the determination relating to the temperature can be performed based on the condition at the time the predetermined time elapses since the heater 40 is turned on. In this way, in the image forming apparatus 100, the determination relating to the temperature can be accurately performed.

As one embodiment, in the image forming apparatus 100, the control section 160 notifies the abnormality occurring in the heater 40 if the abnormality occurring in the heater 40 is determined.

Therefore, in the image forming apparatus 100, the abnormality occurring in the heater 40 can be notified to a user or the like.

As one embodiment, in the image forming apparatus 100, the control section 160 notifies the abnormality occurring in the temperature sensor 62 if the abnormality occurring in the temperature sensor 62 is determined.

Therefore, in the image forming apparatus 100, the abnormality occurring in the temperature sensor 62 can be notified to a user or the like.

As one embodiment, in the image forming apparatus 100, the fixing device 30 includes a thin film sliding on the surface of the heating element 45 with one surface thereof contacting the heating element 45, and a rotation member that can be pressed against the other surface of the thin film and can be rotatably driven. In at least one embodiment, the thin film is the cylindrical film 35. In at least one embodiment, the rotation member is the pressure roller 30*p*.

Therefore, the image forming apparatus 100 can determine the abnormality occurring in the heater 40 when the fixing device 30 of such a fixing system is used.

As one embodiment, the image forming method used by the image forming apparatus 100 can be provided.

The image forming method includes a step in which the image forming apparatus 100 detects a voltage of a power supply that supplies the electric power to the heater 40.

The image forming method includes a step in which the image forming apparatus 100 determines the abnormality occurring in the heater 40 if the voltage drop amount at the time the heater 40 is turned on as compared to a case in which the heater 40 is turned off is smaller than the first threshold value.

Therefore, by the image forming method, the abnormality occurring in the heater 40 can be determined.

As one embodiment, the non-transitory recording medium can be provided.

Specifically, the non-transitory recording medium stores a program having instructions for enabling a computer to function as the image forming apparatus 100. In at least one embodiment, the computer may operate as the control section for the image forming apparatus.

Therefore, through the non-transitory recording medium, the abnormality occurring in the heater 40 can be determined.

Programs for performing functions of the image forming apparatus 100 according to the embodiments described above may be stored in a computer-readable recording medium. Then, the processing may be performed by enabling a computer system to read and execute the programs recorded on the recording medium. The computer system may include an OS (Operating System) or hardware such as a peripheral device. The computer-readable recording medium may be a portable medium such as a flexible disk, a magneto-optical disk, a ROM (Read Only Memory), a writable non-volatile memory such as a flash memory or a DVD (Digital Versatile Disc), or the like. The computer-readable recording medium may be a storage device such as a hard disk built in the computer system.

The computer-readable recording medium may be a non-transitory recording medium.

The above programs may be used for performing a part of the functions described above. Furthermore, the above program may be a so-called difference file (difference program) that can perform the above-described functions in combination with programs already recorded in the computer system.

The function of any component in any apparatus described above may be performed by a processor. For example, each processing in at least one embodiment may be performed by the processor operating based on information such as a program and a computer-readable recording medium that stores the information such as the program. In the processor, the functions of each section may be performed by individual hardware and/or integral hardware. For example, the processor may include the hardware, and the hardware may include at least one of a circuit for processing digital signals and a circuit for processing analog signals. For example, the processor may be configured by one or more circuit devices and/or one or more circuit elements mounted on a circuit board. A circuit device may be an IC (Integrated Circuit), for example, and the circuit element may be a resistor or a capacitor.

Here, the processor may be a CPU. However, the processor is not limited to a CPU, and various processors such as a GPU (Graphics Processing Unit) or a DSP (Digital Signal Processor) may be used. The processor may be a hardware circuit with an ASIC (Application Specific Integrated Circuit). The processor may be configured by a plurality of CPUs, or may be configured by a hardware circuit with a plurality of ASICs. The processor may be configured by a combination of a plurality of CPUs and the hardware circuit with a plurality of ASICs. The processor may include one or more of an amplifier circuit or a filter circuit or the like that processes the analog signal.

While certain embodiments have been described these embodiments have been presented by way of example only, and are not intended to limit the scope of the inventions. Indeed, the novel embodiments described herein may be embodied in a variety of other forms. Furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. An image forming apparatus, comprising:

a heater configured to be turned on or turned off, and to generate heat when the heater is turned on;

a fixing device configured to fix a developer image on a surface of an image forming medium using the heat generated by the heater;

a temperature sensor configured to measure the temperature of the fixing device, and a controller configured to determine a voltage of a power supply for supplying electric power to the heater, to determine an occurrence of an abnormality in the heater when a voltage drop amount at a time when the heater is turned on as compared to a time when the heater is turned off is smaller than a first threshold value, to determine an occurrence of an abnormality in the temperature sensor, and to provide a notification of the occurrence of the abnormality in the temperature sensor upon determining occurrence of the abnormality in the temperature sensor.

2. The image forming apparatus according to claim 1, wherein the controller is configured to determine the occurrence of the abnormality in the heater when the temperature measured by the temperature sensor is lower than a second threshold value and the voltage drop amount at the time when the heater is turned on as compared to the time when the heater is turned off is smaller than the first threshold value.

3. The image forming apparatus according to claim 2, wherein the controller is configured to determine the occurrence of the abnormality in the heater when the temperature measured by the temperature sensor is lower than the second threshold value after a predetermined time has elapsed since the heater is turned on.

4. The image forming apparatus according to claim 2, wherein the controller is configured to determine the occurrence of the abnormality in the temperature sensor when the temperature detected by the temperature sensor is lower than a third threshold value and the voltage drop amount is greater than the first threshold value at the time when the heater is turned on as compared to the time when the heater is turned off.

5. The image forming apparatus according to claim 4, wherein the controller is configured to determine whether the temperature is lower than the third threshold value after a predetermined time has elapsed since the heater is turned on.

6. The image forming apparatus according to claim 1, wherein the controller is configured to output a notification of the occurrence of the abnormality in the heater upon determining the occurrence of the abnormality.

7. The image forming apparatus according to claim 1, wherein the fixing device includes a film sliding on a surface of a heat generator of the heater, with one surface of the film contacting the heat generator, and a rotation member configured to be pressed against the other surface of the film and configured to be rotatably driven.

8. A method for determining an abnormality in an image forming apparatus comprising a heater configured to be turned on or turned off, a fixing device configured to fix a developer image on a surface of an image forming medium with the heat from the heater, and a temperature sensor configured to measure the temperature of the fixing device, the method comprising:

determining a first voltage of a power supply for supplying, by the image forming apparatus, electric power to the heater, at a time when the heater is turned on;

determining a second voltage of the power supply at a time when the heater is turned off;

determining, by the image forming apparatus, an occurrence of an abnormality in the heater when a voltage drop amount at the time when the heater is turned on as compared to the time when the heater is turned off is smaller than a first threshold value;

determining an occurrence of an abnormality in the temperature sensor; and providing a notification of the occurrence of the abnormality in the temperature sensor upon determining the occurrence of the abnormality in the temperature sensor.

9. The method of claim 8, further comprising:

upon a determination that a difference between the first voltage and the second voltage is smaller than the first threshold voltage, providing a notification of the occurrence of the abnormality in the heater.

10. The method of claim 8, further comprising:

upon a determination that the difference between the first voltage and the second voltage is greater than the first threshold voltage, measuring a temperature of the heater using the temperature sensor at the time when the heater is turned on;

determining whether the measured temperature is lower than a target temperature; and upon a determination that the measured temperature is lower than the target temperature, determining the occurrence of the abnormality in the temperature sensor.

11. The method of claim 10, wherein determining whether the measured temperature is lower than the target temperature further comprises measuring the temperature of the heater after a predetermined period of time has elapsed.

12. The method of claim 10, wherein determining whether the measured temperature is lower than the target temperature is performed before comparing the difference between the first voltage and the second voltage to the first threshold value.

13. The method of claim 9, wherein determining whether the measured temperature is lower than the target temperature is performed after comparing the difference between the first voltage and the second voltage to the first threshold voltage.

14. A non-transitory computer-readable medium storing a program having instructions, which, when executed by a computer, causes the computer to perform operations to control an image forming apparatus, wherein the image forming apparatus comprises a heater configured to be turned on or turned off, and a generator configured to generate heat when the heater is turned on;

a fixing device configured to fix a developer image on a surface of an image forming medium with heat from the heat generator; and a temperature sensor configured to measure the temperature of the fixing device, wherein the operations comprise determining a voltage of a power supply for supplying electric power to the heater, determining an occurrence of an abnormality in the heater when a voltage drop amount at a time when the heater is turned on as compared to a time when the heater is turned off is smaller than a first threshold value, determining an occurrence of an abnormality in the temperature sensor; and providing a notification of the occurrence of the abnormality in the temperature sensor upon determining occurrence of the abnormality in the temperature sensor.

15. The non-transitory computer-readable medium of claim 14, wherein the image forming apparatus further includes:

a pressure roller in contact with a cylinder film;

a support within the cylinder film that is configured to support an inner surface of the cylinder film against the pressure roller;

a heating element in contact with an inner surface of the cylinder film; and a base plate backing the heating element.

16. The non-transitory computer-readable medium of claim 15, wherein the operations further comprise:

determining the occurrence of the abnormality in the temperature sensor when the voltage drop amount is smaller than the first threshold value and when a measured temperature is lower than a second threshold value after a predetermined period of time has elapsed since the heater is turned on.

17. The non-transitory computer-readable medium of claim 15, wherein the operations further comprise controlling a thermostat to shut off the power supply to the heater when the measured temperature exceeds a predetermined temperature.

* * * * *